US010043624B2

(12) United States Patent
Wu

(10) Patent No.: US 10,043,624 B2
(45) Date of Patent: Aug. 7, 2018

(54) ELECTRONIC SWITCH DEVICE WITH CERAMIC SHEETS

(71) Applicant: SONG CHUAN PRECISION CO., LTD., New Taipei (TW)

(72) Inventor: Sung-Jen Wu, New Taipei (TW)

(73) Assignee: Song Chuan Precision Co., Ltd., New Taipei (TW)

( * ) Notice: Subject to any disclaimer, the term of this patent is extended or adjusted under 35 U.S.C. 154(b) by 0 days.

(21) Appl. No.: 15/664,113

(22) Filed: Jul. 31, 2017

(65) Prior Publication Data

US 2017/0330716 A1 Nov. 16, 2017

Related U.S. Application Data

(63) Continuation of application No. 14/811,784, filed on Jul. 28, 2015.

(51) Int. Cl.

*H01H 50/02* (2006.01)
*H01H 50/44* (2006.01)
*H01H 50/06* (2006.01)

(52) U.S. Cl.

CPC ..... *H01H 50/443* (2013.01); *H01H 50/026* (2013.01); *H01H 50/06* (2013.01); *H01H 2050/028* (2013.01); *H01H 2050/446* (2013.01)

(58) Field of Classification Search

CPC ..... H01H 50/02–50/06; H01H 2050/446
See application file for complete search history.

(56) References Cited

U.S. PATENT DOCUMENTS

2008/0084260 A1* 4/2008 Swartzentruber .... H01H 50/023 335/151
2013/0102175 A1* 4/2013 Molyneux ..... H05K 5/06 439/272
2015/0187518 A1* 7/2015 Molyneux ..... H01H 1/06 335/154

* cited by examiner

*Primary Examiner* — Ramon M Barrera
(74) *Attorney, Agent, or Firm* — Rosenberg, Klein & Lee

(57) ABSTRACT

An electronic switch device with ceramic sheets includes a base having a base board, and an installation side and a connection side are respectively formed on the top and the underside thereof. A first board extends perpendicularly from the base board. Multiple terminals extend from the connection side of the base board. A device is installed to the installation side. A sheet made of isolating composite material is connected to a portion of the top of the base board and the first side of the first board. A cover is mounted to installation side of the base board and accommodate the device and the sheet. The sheet isolates a portion of the device that may generate sparks from the base board.

12 Claims, 15 Drawing Sheets

ELECTRONIC SWITCH DEVICE WITH CERAMIC SHEETS

REFERENCE TO RELATED APPLICATION

This Application is being filed as a Continuation-in-Part of U.S. patent application Ser. No. 14/811,784, filed on 28 Jul. 2015, currently pending.

BACKGROUND OF THE INVENTION

1. Fields of the invention

The present invention relates is a Continuation-In-Part application of U.S. patent application Ser. No. 14/811,784, filed on Jul. 28, 2015.

2. Descriptions of Related Art

In general precision instruments, the circuit board is the core which may operate with other electronic elements to make the whole instruments operate smoothly. The electronic elements are the basic part in the electronic circuit. They are individually packaging in general and each of them has two or more leads or metal pads. The electronic elements must connect with one another to form an electronic circuit with a specific function, such as the amplifier, the radio receiver, and the oscillator. The general method of connecting with the electronic elements is melting. The electronic elements may be individually packaged by each (resistor, capacitor, inductor, diode, and etc.), or the group with various complexities, such as integrated circuit (operational amplifier, network resistor, logic gate). Besides, the electronic elements may be classified into terminal and connector (for electrical connection device), power cord (for connecting interface or end terminal), switch (capable for controlling the electronic elements ON or OFF), resistor (electronic elements with resistance), protection device (passive elements mounted on the protection circuit in higher voltage or current), capacitor (the elements may storage the electric charges in electric field for filtering, the capacitor may normally change the alternating voltage but not change the constant direct voltage), electro-magnetic sensing device (the electronic elements with magnetism), network (composite electronic element composed of many or many kinds of passive components), memristor, piezoelectric device and crystal resonator (the passive element with Piezoelectricity), power source (current source), sensor, and etc.

The most of above mentioned electronic elements may be packaged by the resin dispensing, especially for the electronic switch elements to isolate and protect from being influenced by the environment. However, the sparkles are generated while the current is ON and two electrically conductive ends are separated from each other. Besides the sparkles may damage the electronic elements, they may also melt and burn the plastic housing which is formed after packaging the electronic element (such like relay, socket of each electronic element, timer, and etc.). The cause of fire may be caused by the sparkles generated from the electronic elements arranged inside the electronic device. Although the package made by resin dispensing may improve the insulating quality, it is not heat-resisting and the resin dispensing may become brittle and hard to have better insulation. Finally, the sparkles may still damage the plastic housing and the inside components.

The present invention intends to provide an electronic switch device with ceramic sheets to eliminate the shortcomings mentioned above.

SUMMARY OF THE INVENTION

The present invention relates to an electronic switch device with ceramic sheets, and comprises a base having a base board, and an installation side is formed on the top of the base board, and a connection side is formed on the underside of the base board. A first board extends perpendicularly from the base board. Multiple terminals extend from the connection side of the base board. A device is installed to the installation side. A first sheet made of isolating composite material is connected to a portion of the top of the base board. The first sheet includes the first side which is in flush with the first end of the base board, and the second side of the first sheet is in contact with the first side of the first board. The first side of the first board faces the first end of the base board. The first sheet isolates contact between the base board and the device. A cover is mounted to the installation side of the base board and has a room defined therein. The device and the first sheet are accommodated in the room in the cover. The first sheet isolates a portion of the device from the base board.

Preferably, the first sheet includes an extension portion that is connected to the first side of the first board, two lateral ends of the first board and the top of the first board. The top of the first board is connected between the two lateral ends of the first board.

Preferably, a second sheet is connected to inside of the cover that faces the first board, and also faces the portion of the top of the base board.

Preferably, the device includes a coil and a metal plate. One end of the metal plate is normally not in contact with two contact points on the first board. The contact points are electrically in contact with the terminals.

Preferably, the first and second sheets are made of ceramic.

Alternatively, the present invention provides another electronic switch device with ceramic sheets, and comprises a base having a base board which includes an installation side formed on the top of the base board, and a connection side formed on the underside of the base board. A first board extends perpendicularly from the base board and includes a first side, a second side, two lateral ends and a top which is connected between the two lateral ends and the first and second sides of the first board. Multiple terminals extend from the connection side of the base board. A device is installed to the installation side. A cover is mounted to the installation side of the base board and includes a room defined therein. The room comprises a first compartment and a second compartment. The inside of the first compartment faces the first side of the first board, the top of the base board and the two lateral ends of the first board. The inside of the first compartment also faces a portion of the top of the installation side of the base board. A sheet made of isolating composite material is connected to the inside of the cover, such that the sheet isolates contact between the isolation side of the base board and the device.

Preferably, the sheet is attached to the inside of the first compartment of the room.

Preferably, the height of the sheet is equal to or shorter than the height of the first board.

Preferably, the device includes a coil and a metal plate. One end of the metal plate is normally not in contact with two contact points on the first board. The contact points are electrically in contact with the terminals.

The primary object of the present invention is to provide an electronic switch device with ceramic sheets which isolate the contact between the device and the base board. Specifically, the ceramic sheets which isolate the positions of the device where sparks may be generated, from the base board.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
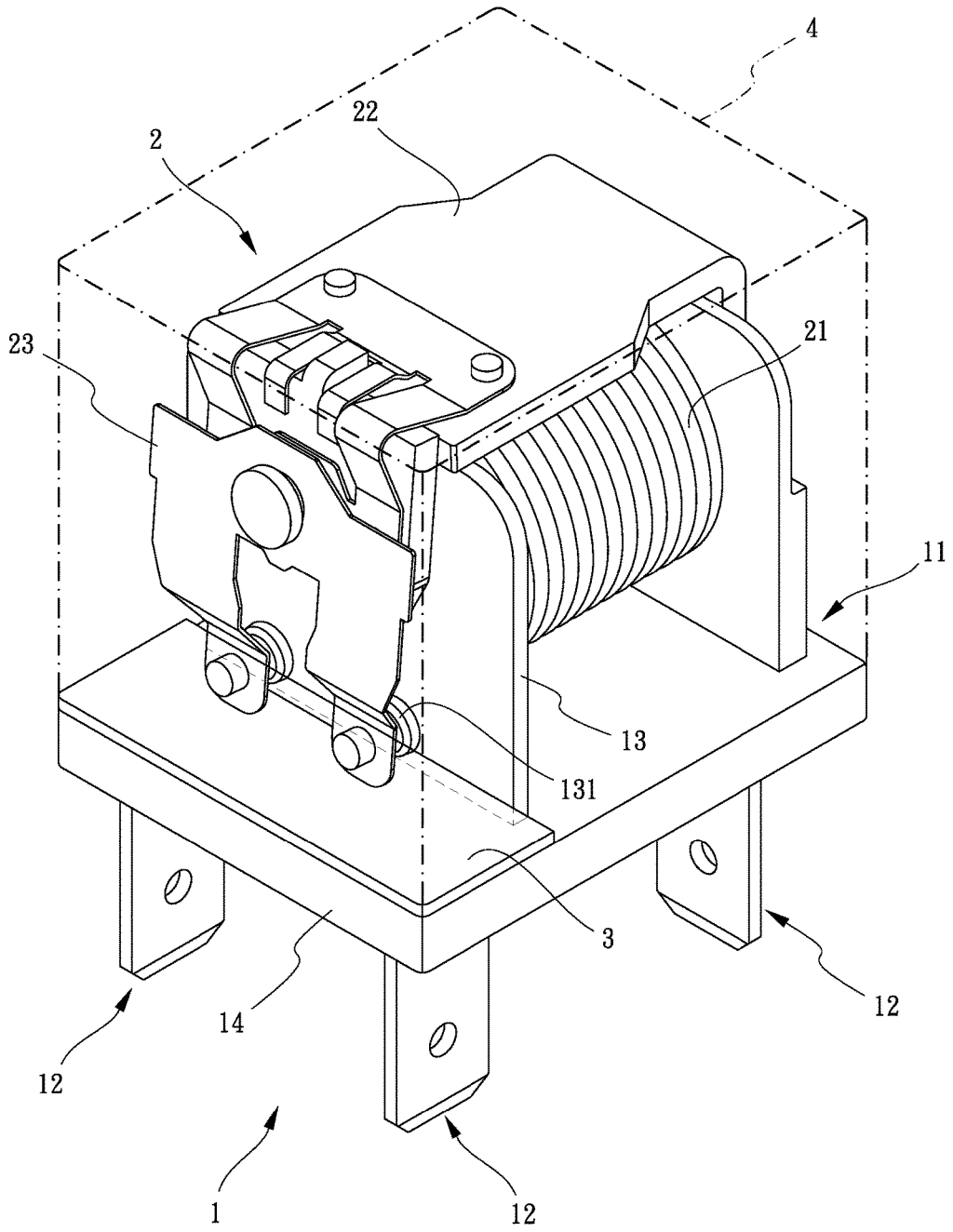
FIG. 1 is a perspective view to show the electronic switch device with ceramic sheets of the present invention.
Figure 2:
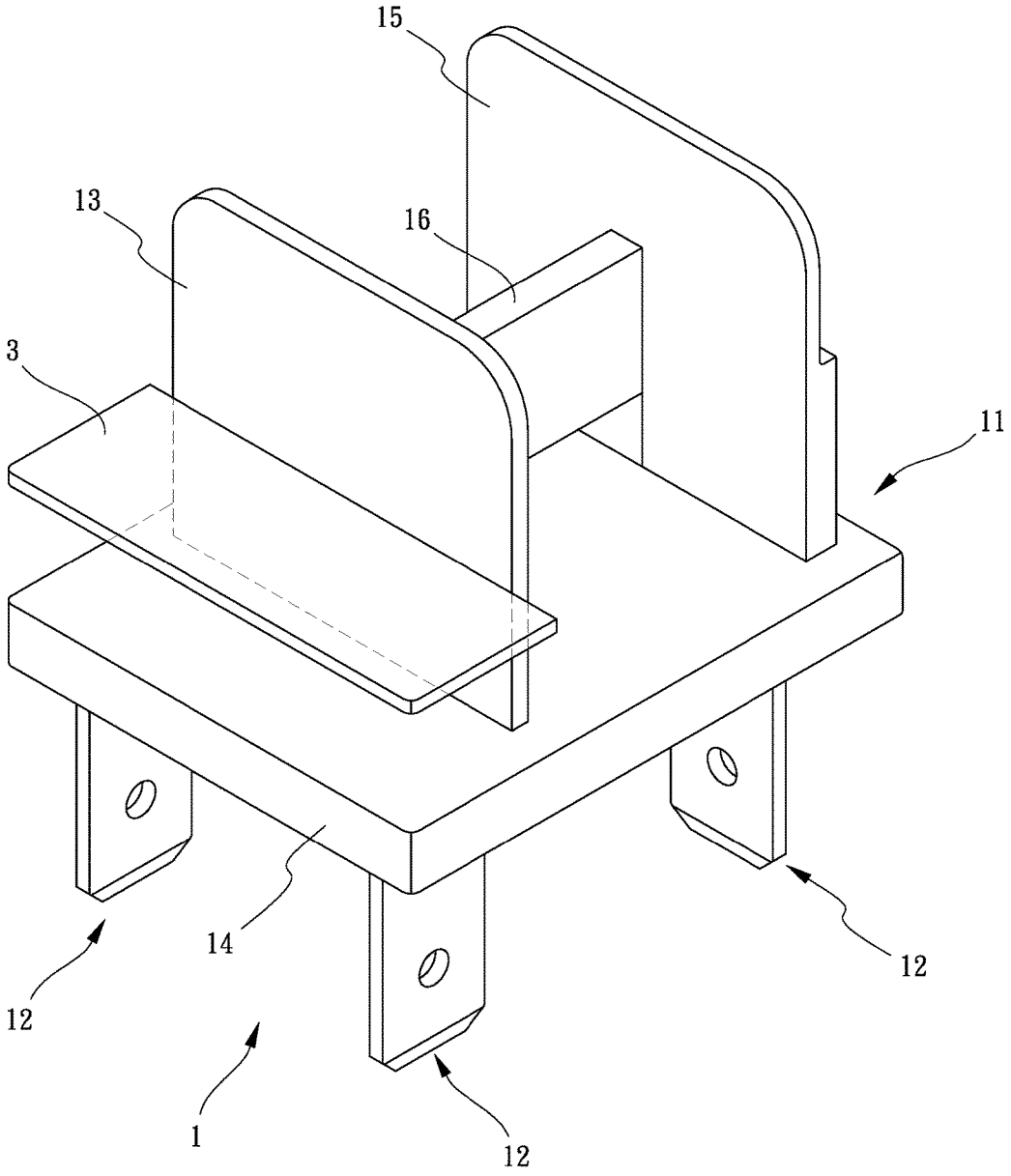
FIG. 2 shows that a first sheet is to be installed to the top of the base board of the electronic switch device with ceramic sheets of the present invention.
Figure 3:
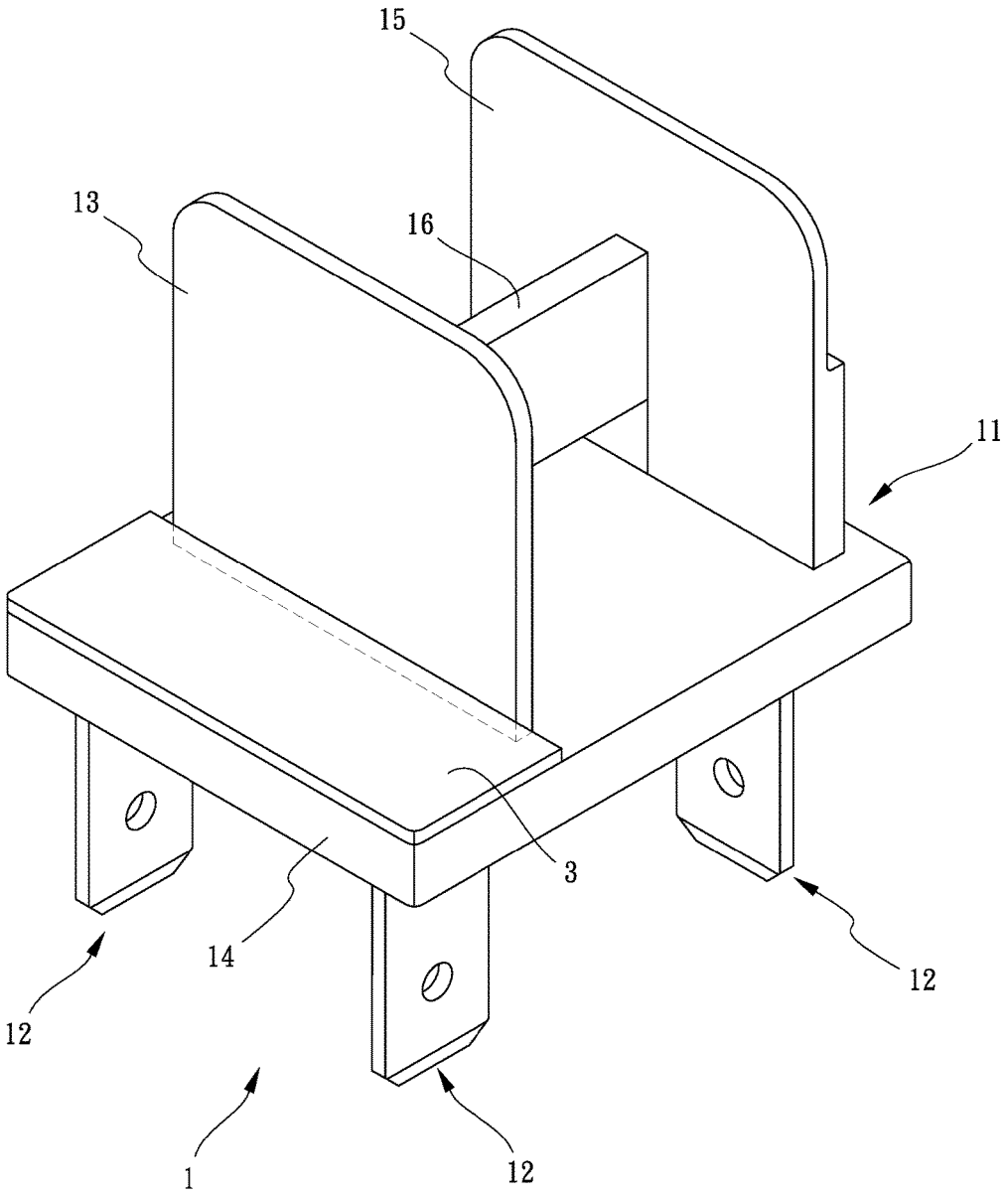
FIG. 3 shows that the first sheet is installed to the top of the base board of the electronic switch device with ceramic sheets of the present invention.
Figure 4:
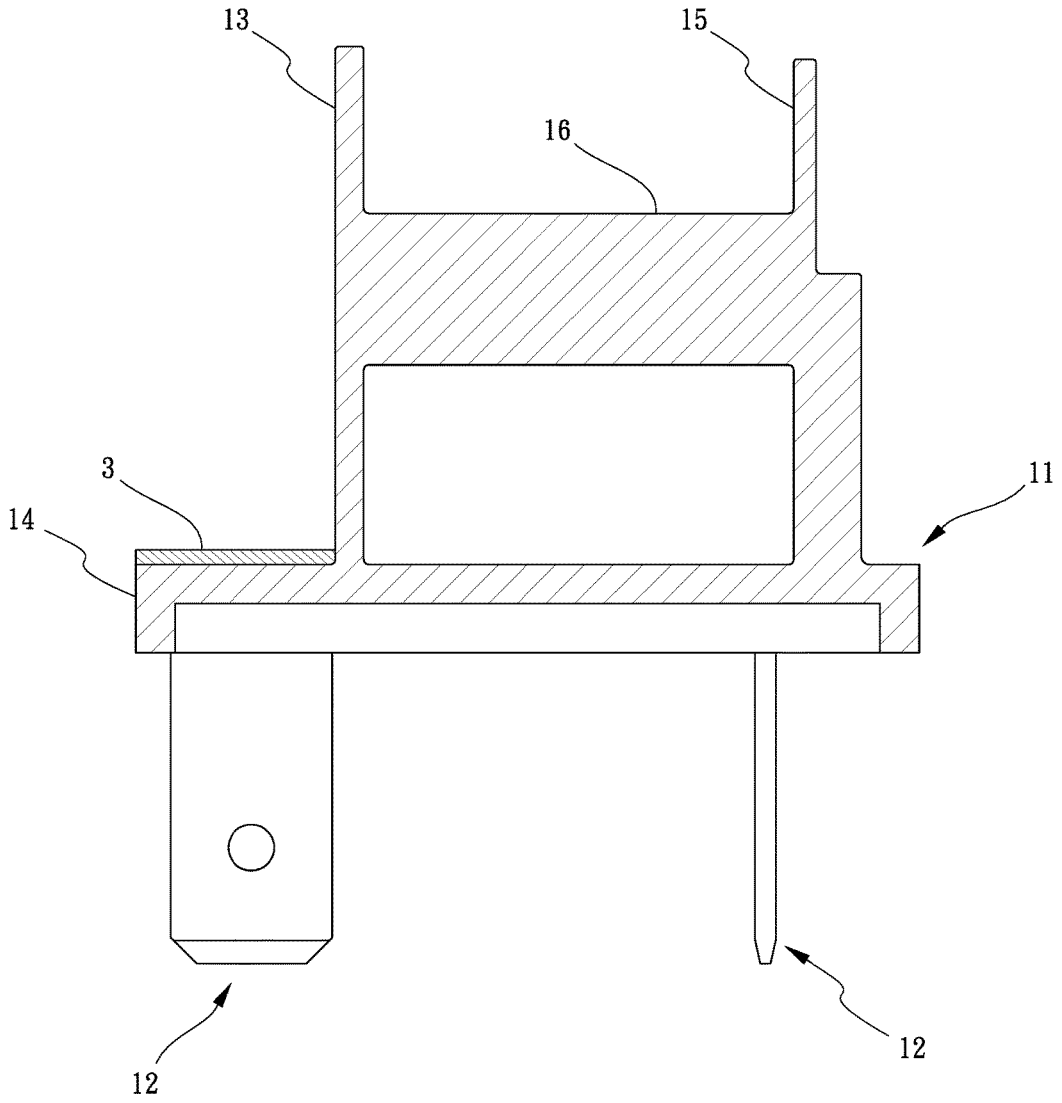
FIG. 4 is a cross sectional view of the disclosure of FIG. 3.
Figure 5:
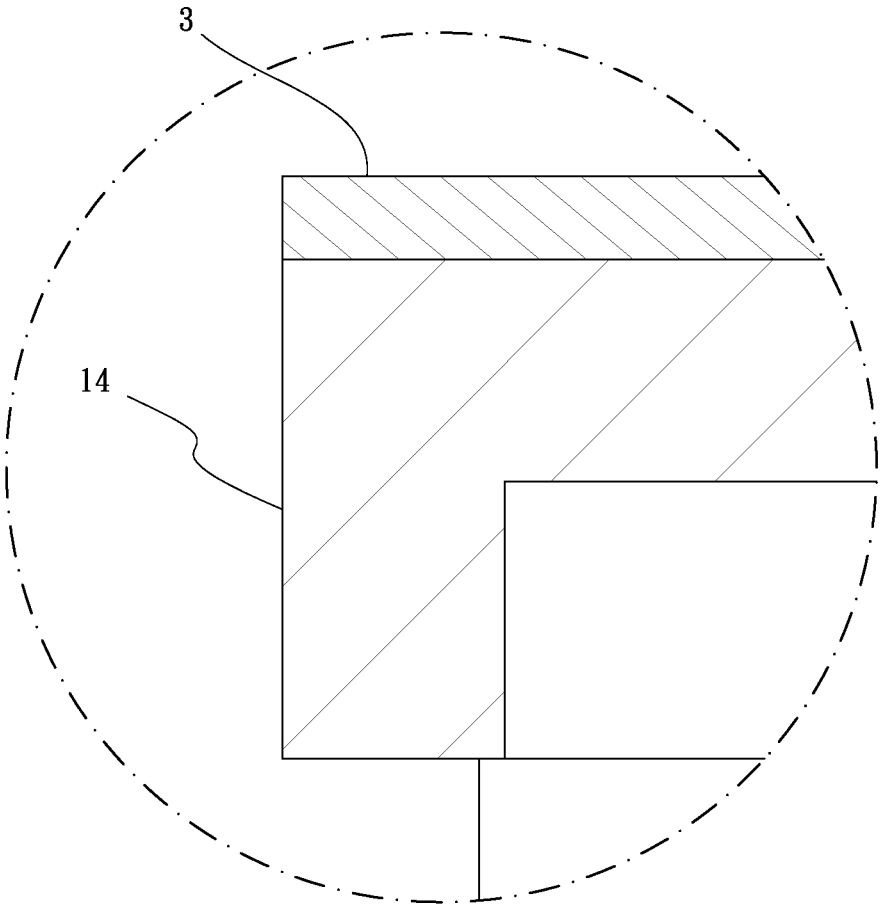
FIG. 5 is an enlarged view to show the connection of the first sheet and the base board.

Referring to FIGS. 1 to 5, the electronic switch device with ceramic sheets of the present invention comprises a base 1 having a base board 14. An installation side 11 is formed on the top of the base board 14, and a connection side is formed on the underside of the base board 14. A first board 13 extends perpendicularly from the base board 14. Multiple terminals 12 extend from the connection side of the base board 14. A device 2 is installed to the installation side 11. A first sheet 3 made of isolating composite material is connected to a portion of the top of the base board 14. The first sheet 3 includes the first side which is in flush with the first end of the base board 14 as shown in FIG. 5, and the second side of the first sheet 3 is in contact with the first side of the first board 13 as shown in FIG. 4. The first side of the first board 13 faces the first end of the base board 14. The first sheet 3 isolates contact between the base board 14 and the device 2. A cover 4 is mounted to the installation side 11 of the base board 14 and has a room 41 defined therein. The device 2 and the first sheet 3 are accommodated in the room 41 in the cover 4. The first sheet 3 isolates a portion of the device 2 from the base board 14. In other words, the position of the device 2 that most likely generates sparks is isolated from the base board 14 by the first sheet 3. The device 2 can be a switch, a keypad, a relay, a contactor, a thermostat, a circuit breaker, a limit switch, a mercury switch, a centrifugal switch or a connector. All of the devices 2 have a plastic housing which can easily be melt by sparks generated by the internal parts in the devices. The present invention effectively avoids the situation to protect the devices. The device 2 includes a coil 21, a connection member 22, and a metal plate 23. One end of the metal plate 23 is normally not in contact with two contact points 131 on the first board 13. The contact points 131 are electrically in contact with the terminals 12. A second board 15 extends perpendicularly from the installation side 11, and a third board 16 is connected between the first and second boards 13, 15. The coil 21 is mounted to the third board 16. The connection member 22 is located above the coil 21 and connected across the first and second boards 13, 15. The metal plate 23 has one end connected to the connection member 22, and the other end of the metal plate 23 is located away from the contact points 131 and electrically connected to the contact points 131. The metal plate 23 and two contact points 131 of the first board 13 are close to the base board 14. When the metal plate 23 and two contact points 131 of the first board 13 are electrically in contact with each other, the sudden transmission of the electric power may cause sparks. Therefore, the first sheet 3 on the top of the base board 14 isolates the sparks from the base board 14.

Figure 6:
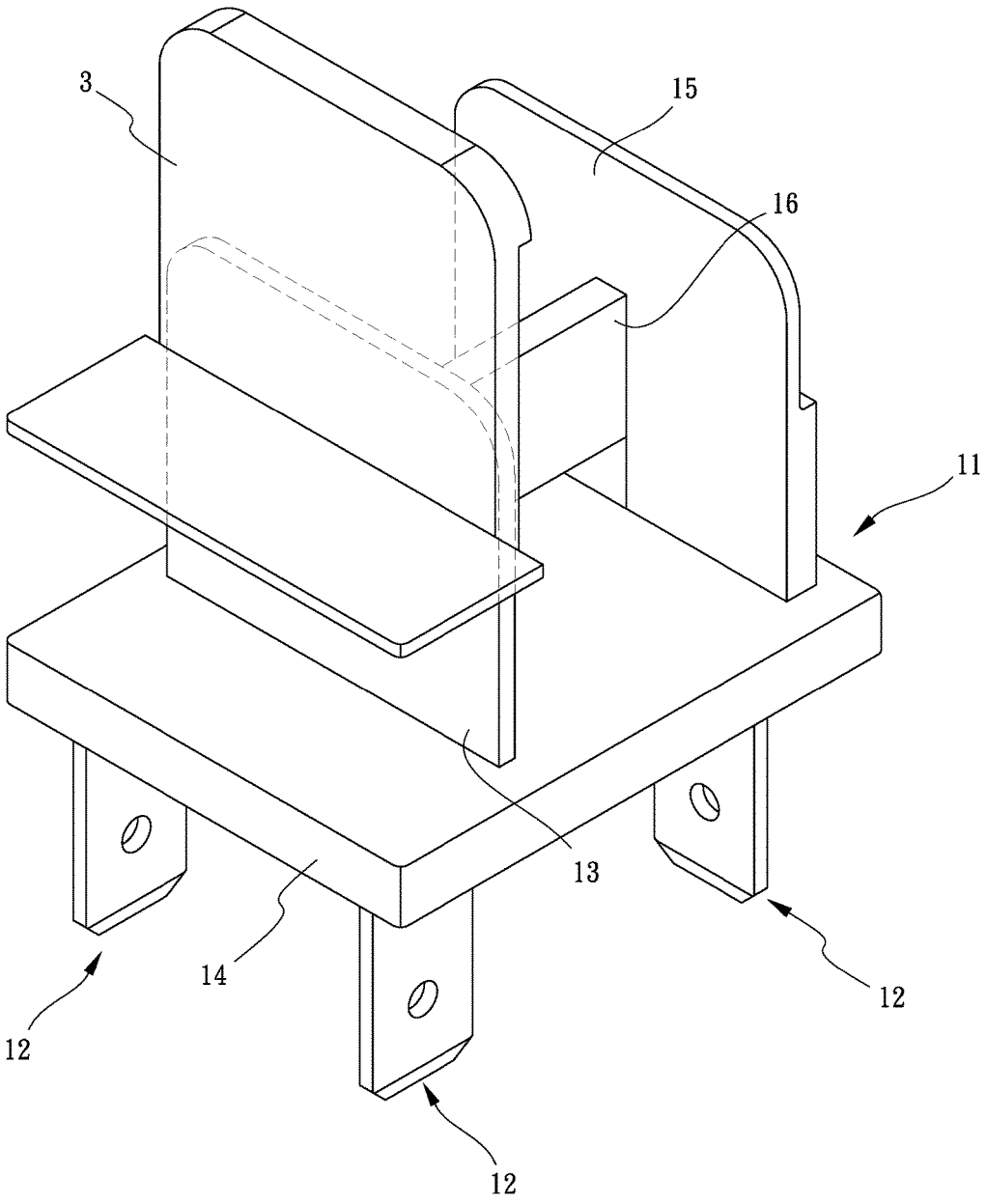
FIG. 6 shows the second embodiment of the electronic switch device with ceramic sheets of the present invention.
Figure 7:
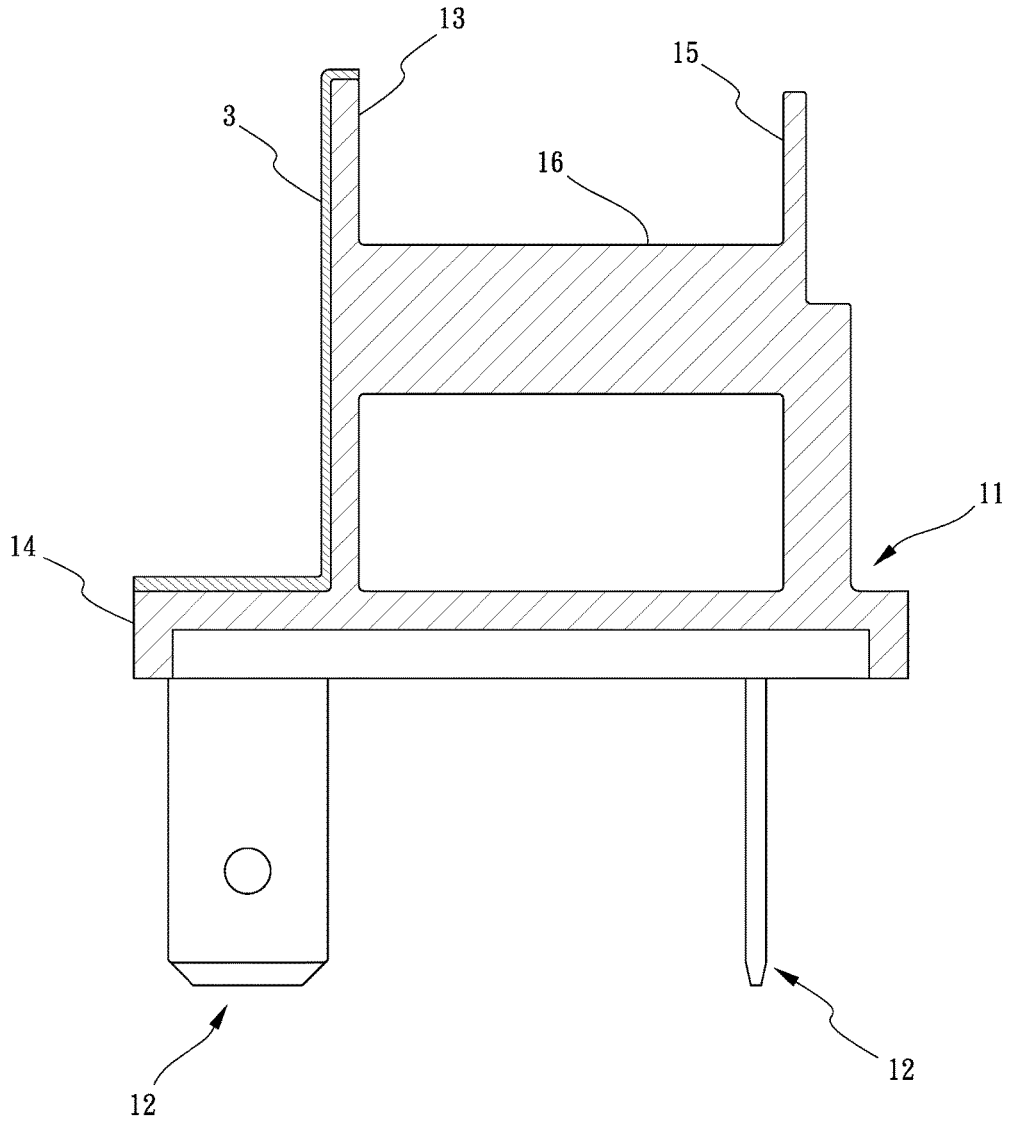
FIG. 7 shows the cross sectional view of the disclosure of FIG. 6.

The first sheet 3 are made of ceramic and is shaped to be fit to the shape of the base board 14. As shown in FIGS. 6 and 7, the second embodiment shows that the first sheet 3 includes an extension portion that is connected to the first side of the first board 13, two lateral ends of the first board 13 and the top of the first board 13, wherein the top of the first board 13 is connected between the two lateral ends of the first board 13. The first sheet 3 includes a substantial L-shaped when viewed from one side thereof, and the first sheet 3 is easily replaced and installed. The first sheet 3 isolates the possible sparks generated between the metal plate 23 and the contact points 131 from the base board 14 and the first board 13.

Figure 8:
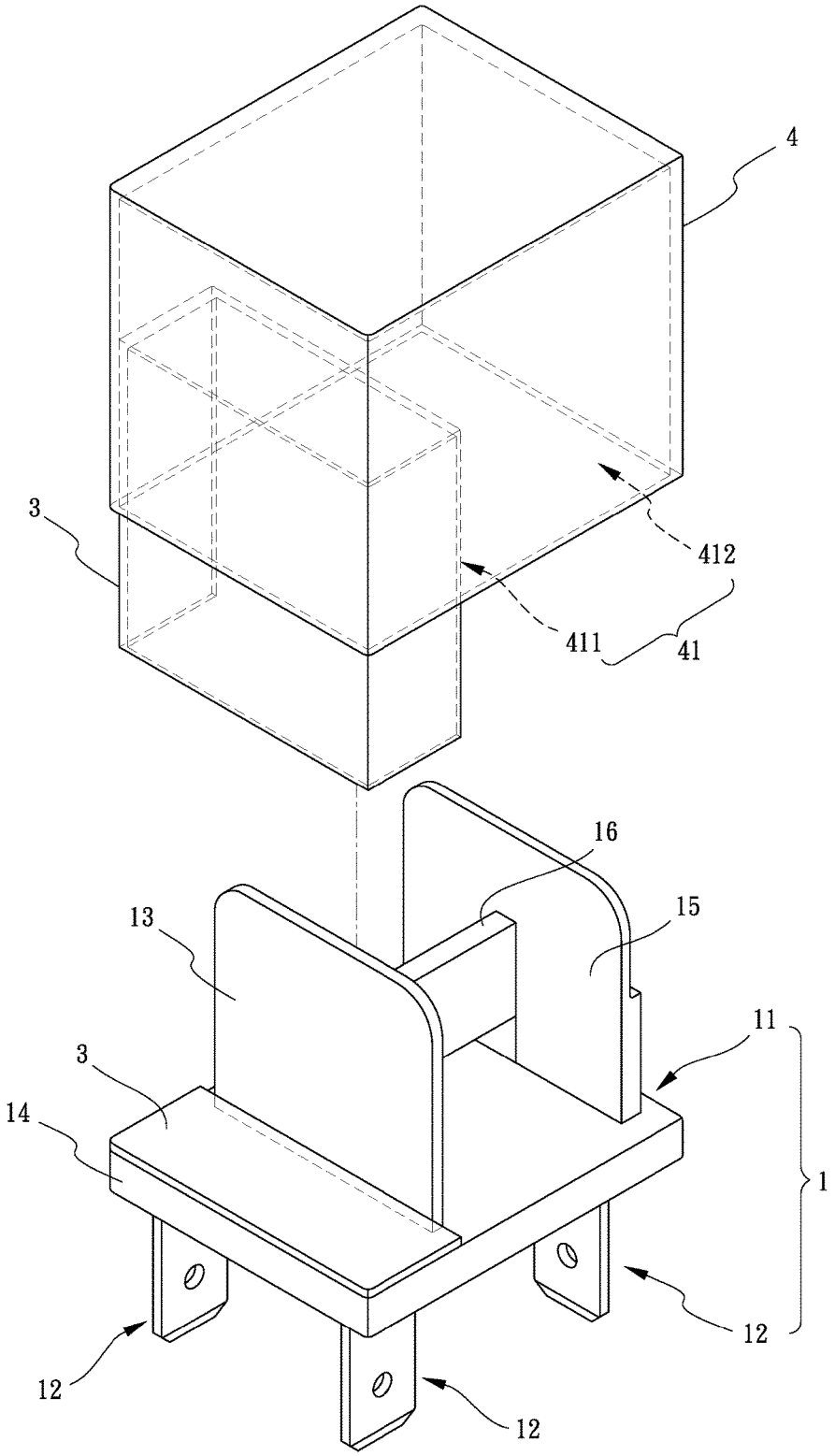
FIG. 8 shows the third embodiment of the electronic switch device with ceramic sheets of the present invention.
Figure 9:
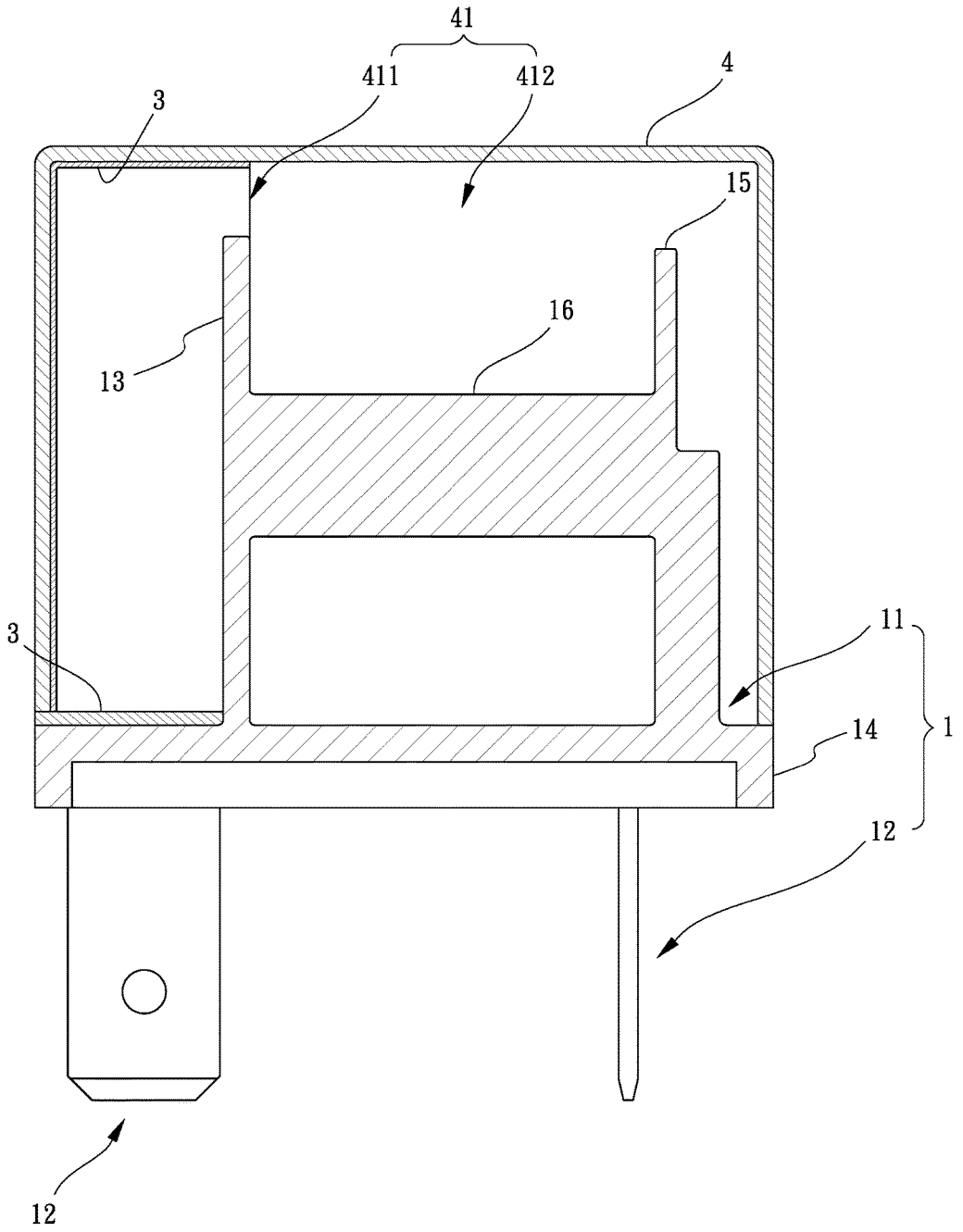
FIG. 9 shows the cross sectional view of the disclosure of FIG. 8.

FIGS. 8 and 9 show the third embodiment, wherein the difference of the third embodiment from the first embodiment is that the room 41 comprises a first compartment 411 and a second compartment 412. The inside of the first compartment 411 faces the first side of the first board 13, the top of the base board 14 and the two lateral ends of the first board 13. The inside of the first compartment 411 also faces a portion of the top of the installation side 11 of the base board 14. A second sheet 30 made of isolating composite material is connected to the inside of the cover 4, such that the second sheet 30 isolates contact between the isolation side 11 of the base board 14 and the device 2.

Figure 10:
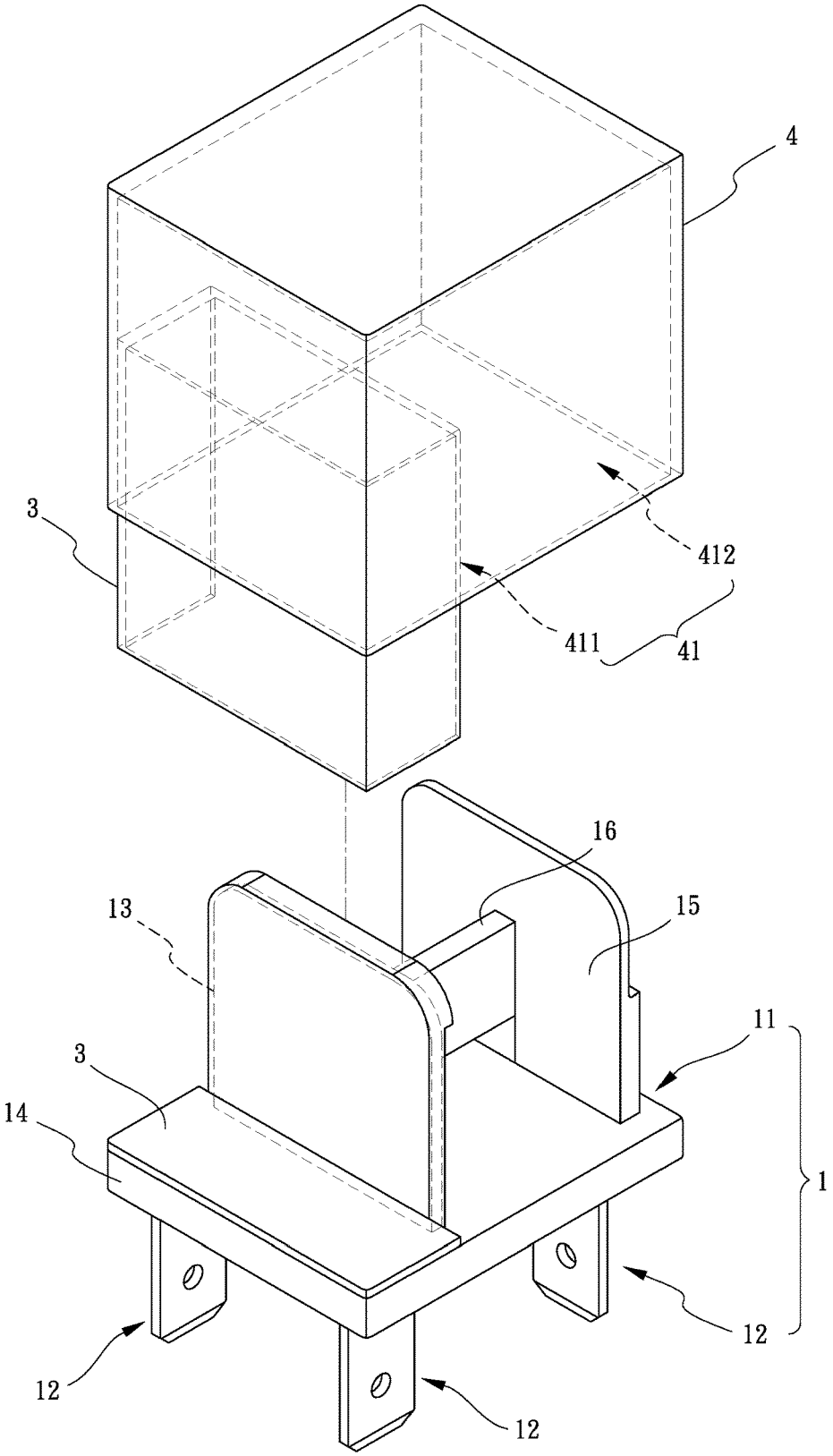
FIG. 10 shows the fourth embodiment of the electronic switch device with ceramic sheets of the present invention.
Figure 11:
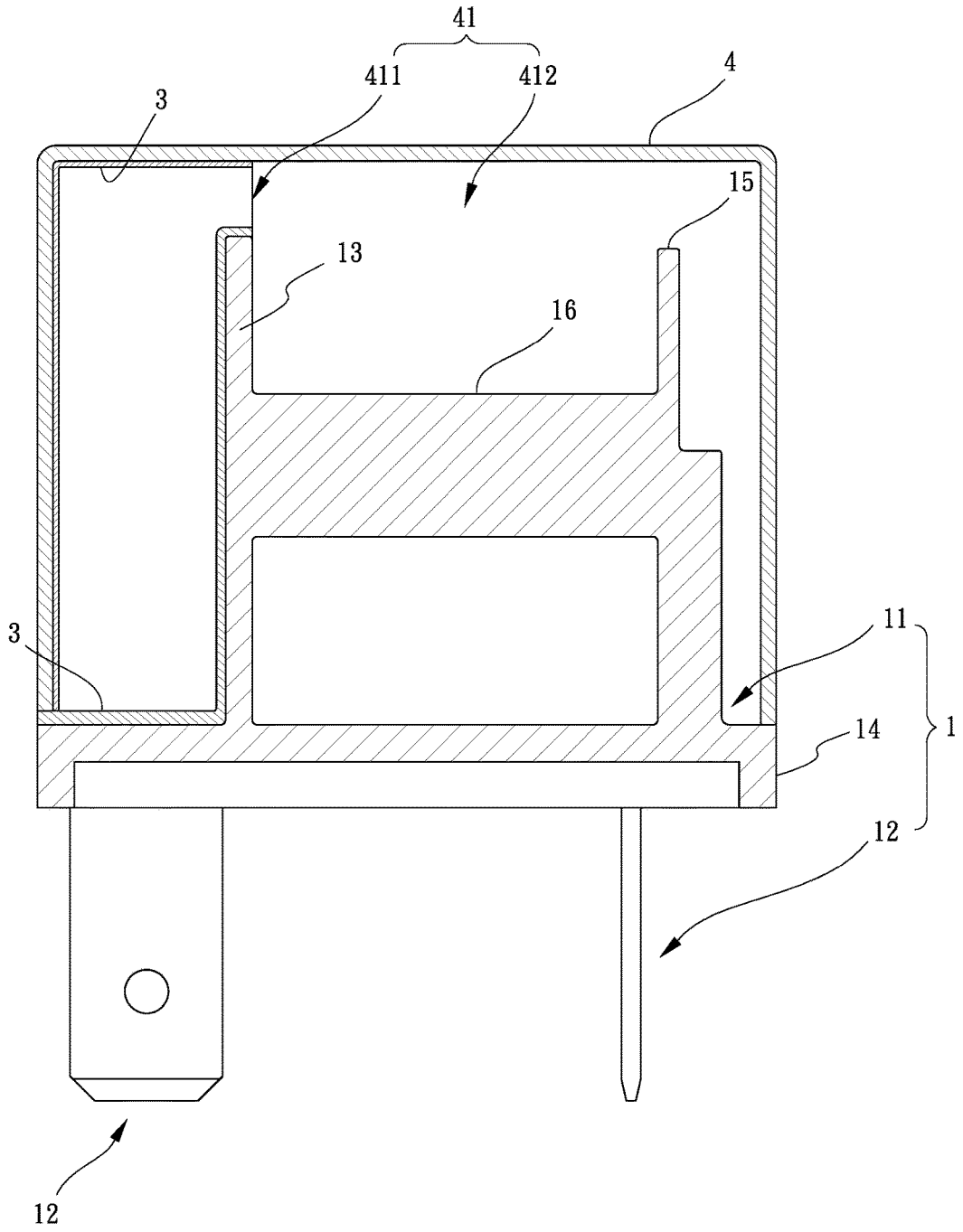
FIG. 11 shows the cross sectional view of the disclosure of FIG. 10.

FIGS. 10 and 11 show the fourth embedment, wherein the difference of the fourth embodiment from the second embodiment is that the room 41 comprises a first compartment 411 and a second compartment 412. The inside of the first compartment 411 faces the first side of the first board 13, the top of the base board 14 and the two lateral ends of the first board 13. The inside of the first compartment 411 also faces a portion of the top of the installation side 11 of the base board 14. A second sheet 30 made of isolating composite material is connected to the inside of the cover 4, such that the second sheet 30 isolates contact between the isolation side 11 of the base board 14 and the device 2.

Figure 12:
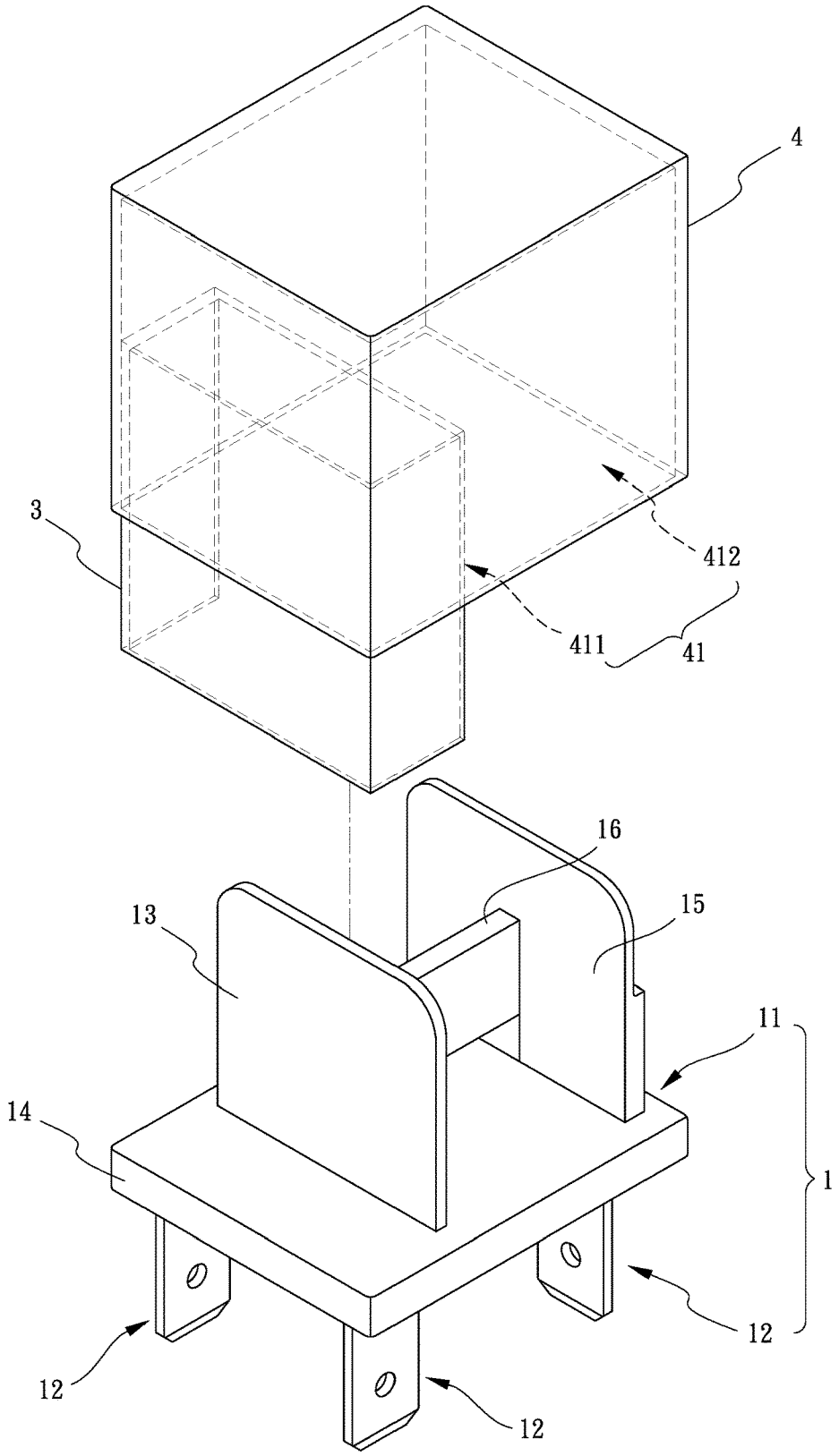
FIG. 12 shows the fifth embodiment of the electronic switch device with ceramic sheets of the present invention.
Figure 13:
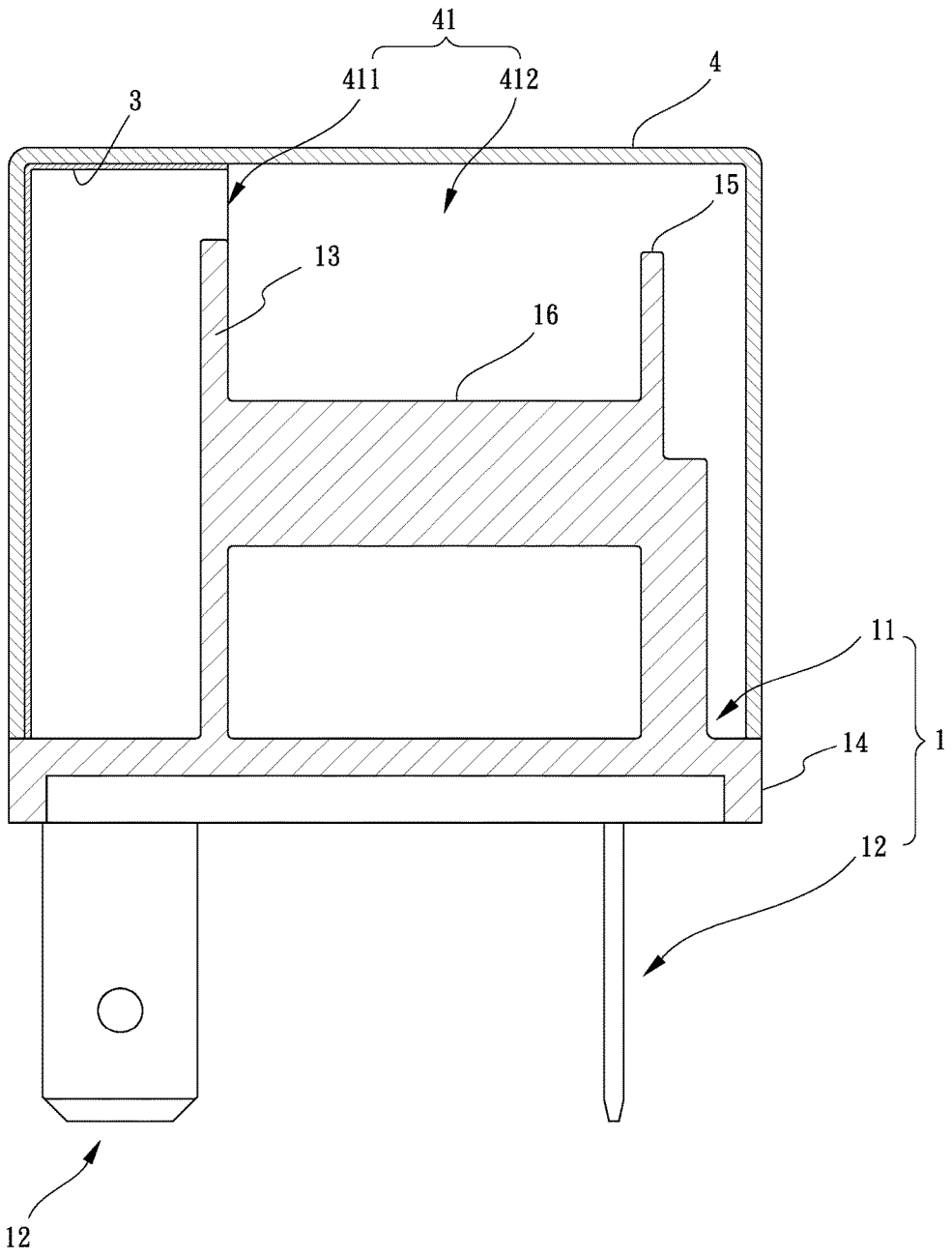
FIG. 13 shows the cross sectional view of the disclosure of FIG. 12.

FIGS. 12 and 13 show the fifth embodiment of the present invention, wherein the difference from the previous four embodiment is that there is no first sheet 3 on the top of the base board 14, and only sheet is the second sheet 30 made of isolating composite material is connected to the inside of the cover 4 to protect the cover 4 from being damaged by possible sparks.

Figure 14:
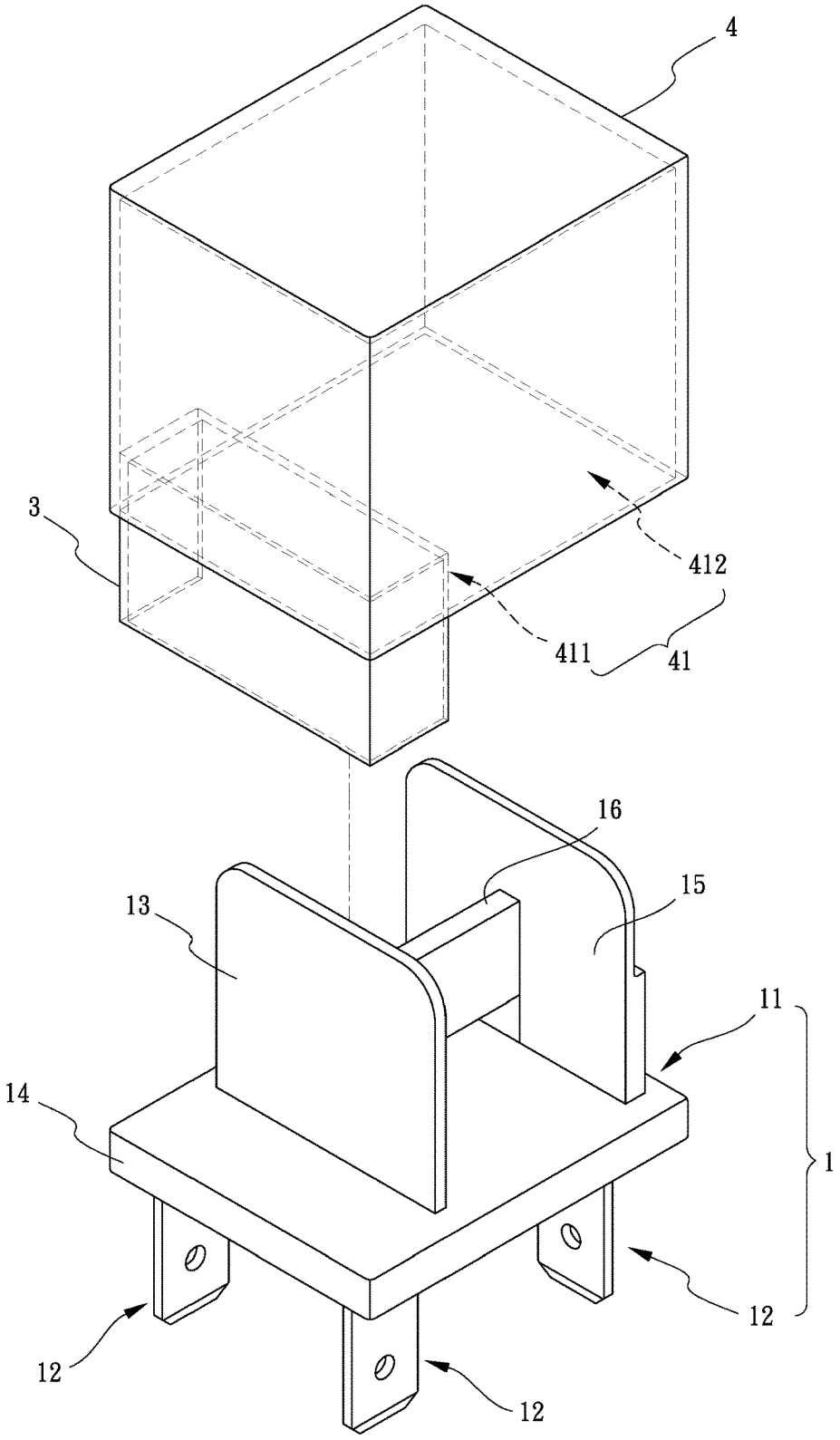
FIG. 14 shows the sixth embodiment of the electronic switch device with ceramic sheets of the present invention.
Figure 15:
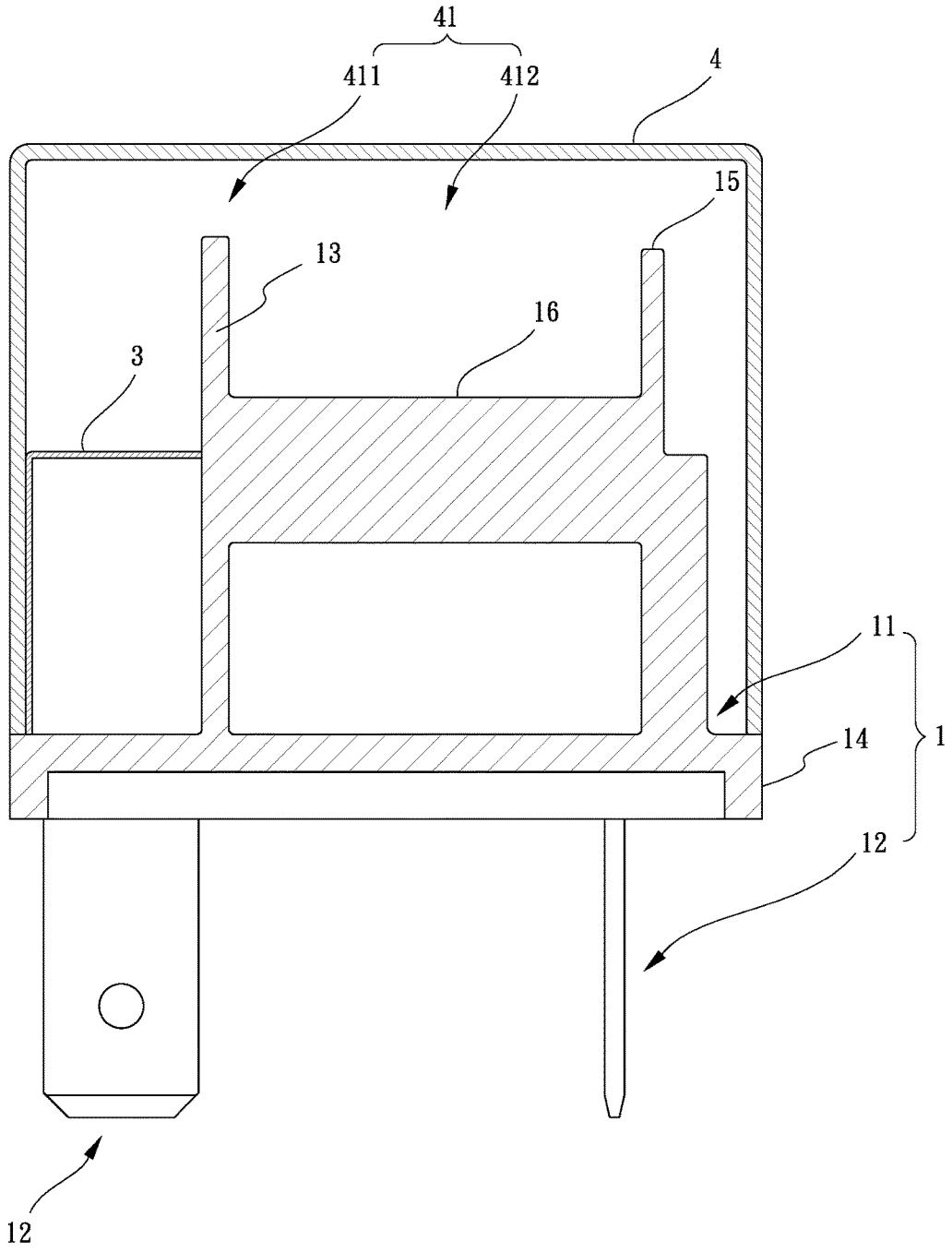
FIG. 15 shows the cross sectional view of the disclosure of FIG. 14.

FIGS. 14 and 15 show the sixth embodiment of the present invention, the difference from the fifth embodiment is to reduce 50% of the height of the second sheet 30 along the upright inside of the cover 1. That is to say, the second sheet 30 is attached to the inside from the lower end (open end) of the cover 4 to a half height of the first board 13. In general, the height of the second sheet 30 can be equal to or shorter than the height of the first board 13. The second sheet 30 covers the position where the two contact points 131 and the end of the metal plate 23 are located.

The first and second sheets 3, 30 effectively isolate the position where the two contact points 131 and the end of the metal plate 23 are located, and the base board 14 so as to protect the device 2 and the base board 14 from being damaged by sparks generated between the two contact points 131 and the end of the metal plate 23.

While we have shown and described the embodiment in accordance with the present invention, it should be clear to those skilled in the art that further embodiments may be made without departing from the scope of the present invention.

What is claimed is:

1. An electronic switch device with ceramic sheets, comprising:

a base having a base board, an installation side formed on a top of the base board, a connection side formed on an underside of the base board, a first board extending perpendicularly from the base board, multiple terminals extending from the connection side of the base board;

a device installed to the installation side;

a first sheet made of isolating composite material and connected to a portion of the top of the base board, the first sheet including a first side which is in flush with a first end of the base board, a second side of the first sheet being in contact with a first side of the first board, the first side of the first board facing the first end of the base board, the first sheet isolating contact between the base board and the device, and a cover mounted to the installation side of the base board, the device and the first sheet being accommodated in a room defined in the cover, the first sheet isolating a portion of the device from the base board.

2. The electronic switch device with ceramic sheets as claimed in claim 1, wherein the first sheet includes an extension portion that is connected to the first side of the first board, two lateral ends of the first board and a top of the first board, the top of the first board is connected between the two lateral ends of the first board.

3. The electronic switch device with ceramic sheets as claimed in claim 1, wherein a second sheet is connected to inside of the cover that faces the first board, and the portion of the top of the base board.

4. The electronic switch device with ceramic sheets as claimed in claim 2, wherein a second sheet is connected to inside of the cover that faces the first board, and the portion of the top of the base board.

5. The electronic switch device with ceramic sheets as claimed in claim 1, wherein the device includes a coil and a metal plate, one end of the metal plate is normally not in contact with two contact points on the first board, the contact points are electrically in contact with the terminals.

6. The electronic switch device with ceramic sheets as claimed in claim 5, wherein the first sheet is made of ceramic.

7. The electronic switch device with ceramic sheets as claimed in claim 5, wherein the second sheet is made of ceramic.

8. An electronic switch device with ceramic sheets, comprising:

a base having a base board, an installation side formed on a top of the base board, a connection side formed on an underside of the base board, a first board extending perpendicularly from the base board, the first board including a first side, a second side, two lateral ends and a top which is connected between the two lateral ends and the first and second sides of the first board, multiple terminals extending from the connection side of the base board;

a device installed to the installation side;

a cover mounted to the installation side of the base board and including a room defined therein, the room comprising a first compartment and a second compartment, an inside of the first compartment facing the first side of the first board, the top of the base board and the two lateral ends of the first board, the inside of the first compartment also facing a portion of the top of the installation side of the base board, and a sheet made of isolating composite material and connected to the inside of the cover, the sheet isolating contact between the installation side of the base board and the device.

9. The electronic switch device with ceramic sheets as claimed in claim 8, wherein the sheet is attached to the inside of the first compartment of the room.

10. The electronic switch device with ceramic sheets as claimed in claim 8, wherein a height of the sheet is equal to or shorter than a height of the first board.

11. The electronic switch device with ceramic sheets as claimed in claim 9, wherein the device includes a coil and a metal plate, one end of the metal plate is normally not in contact with two contact points on the first board, the contact points 131 are electrically in contact with the terminals.

12. The electronic switch device with ceramic sheets as claimed in claim 10, wherein the device includes a coil and a metal plate, one end of the metal plate is normally not in contact with two contact points on the first board, the contact points are electrically in contact with the terminals.

* * * * *